US008685182B2

(12) United States Patent
Nagai et al.

(10) Patent No.: US 8,685,182 B2
(45) Date of Patent: Apr. 1, 2014

(54) HIGH-STRENGTH STEEL PIPE AND PRODUCING METHOD THEREOF

(75) Inventors: Kensuke Nagai, Tokyo (JP); Yasuhiro Shinohara, Tokyo (JP); Shinya Sakamoto, Tokyo (JP); Takuya Hara, Tokyo (JP); Hitoshi Asahi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 50 days.

(21) Appl. No.: 13/261,070

(22) PCT Filed: Jun. 10, 2010

(86) PCT No.: PCT/JP2010/003866

§ 371 (c)(1),
(2), (4) Date: Jan. 30, 2012

(87) PCT Pub. No.: WO2010/143433

PCT Pub. Date: Dec. 16, 2010

(65) Prior Publication Data

US 2012/0118425 A1 May 17, 2012

(30) Foreign Application Priority Data

Jun. 11, 2009 (JP) ..... 2009-140280

(51) Int. Cl.

| | |
|---|---|
| ***C22C 38/48*** | (2006.01) |
| ***C22C 38/50*** | (2006.01) |
| ***C21D 8/10*** | (2006.01) |

(52) U.S. Cl.

USPC ..... 148/333; 148/334; 148/335; 148/909; 148/593; 148/519; 148/520; 148/521; 138/177

(58) Field of Classification Search

USPC ..... 148/593, 519–521, 320, 333–335, 909; 138/177

See application file for complete search history.

(56) References Cited

U.S. PATENT DOCUMENTS

2011/0079328 A1* 4/2011 Yokoi et al. ..... 148/504

FOREIGN PATENT DOCUMENTS

| | | |
|---|---|---|
| EP | 1860204 | 11/2007 |
| EP | 2028284 | 2/2009 |
| JP | 2002-097551 | 4/2002 |
| JP | 2002-363686 | 12/2002 |
| JP | 2003-293089 | 10/2003 |
| JP | 2006-144037 | 6/2006 |

(Continued)

OTHER PUBLICATIONS

International Search Report dated Aug. 17, 2010 issued in corresponding PCT Application No. PCT/JP2010/003866.

(Continued)

*Primary Examiner* — Deborah Yee
(74) *Attorney, Agent, or Firm* — Kenyon & Kenyon LLP

(57) ABSTRACT

This high-strength steel pipe includes, by mass %, C: 0.02% to 0.09%, Mn: 0.4% to 2.5%, Cr: 0.1% to 1.0%, Ti: 0.005% to 0.03%, Nb: 0.005% to 0.3%, and a balance consisting of Fe and inevitable impurities, in which Si, Al, P, S, and N are limited to 0.6% or less, 0.1% or less, 0.02% or less, 0.005% or less, 0.008% or less, respectively, the bainite transformation index BT is 650° C. or less, and the microstructure thereof is a single bainite microstructure including first bainite and second bainite, the first bainite being a gathered microstructure of bainitic ferrite including no carbide, and the second bainite being a mixed microstructure of bainitic ferrite including no carbide and cementite between the bainitic ferrites.

5 Claims, 3 Drawing Sheets

(56) References Cited

FOREIGN PATENT DOCUMENTS

| | | |
|---|---|---|
| JP | 2006-207018 | 8/2006 |
| JP | 2006-283131 | 10/2006 |
| JP | 2006-283147 | 10/2006 |
| JP | 2006-299413 | 11/2006 |
| JP | 2006-299414 | 11/2006 |
| JP | 2008-248315 | 10/2008 |

OTHER PUBLICATIONS

European Search Report dated Dec. 18, 2012, issued in corresponding European Application No. 10785965.4.

Notice of Allowance dated Nov. 18, 2013 issued in corresponding Korean Application No. 10-2011-7030056 [With English Translation].

* cited by examiner

FERRITE-BAINITE MICROSTRUCTURE

SINGLE BAINITE MICROSTRUCTURE

HIGH-STRENGTH STEEL PIPE AND PRODUCING METHOD THEREOF

This application is a national stage application of International Application No. PCT/JP2010/003866, filed 10 Jun. 2010, which claims priority to Japanese Patent Application No. 2009-140280, filed Jun. 11, 2009, the content of which is incorporated herein by reference.

FIELD OF THE INVENTION

The present invention relates to a high-strength steel pipe that is excellent in terms of the deformation characteristics immediately after the production (as-produced, before aging) and after aging, and a producing method thereof.

DESCRIPTION OF RELATED ART

Recently, the environments for laying pipe lines, which are extremely important as a long-distance transportation system of petroleum and natural gas have, become more severe. For example, the influence of periodic melting and freezing of frozen soils in discontinuous permafrost regions, the influence of landslides in earthquake regions, and the influence of oceanic currents at the sea bottom have made it impossible to ignore the bending deformation of pipe lines. Therefore, there is demand for a steel pipe for line pipes to be excellent in terms of the internal pressure resistance, not to easily allow buckling to occur with respect to bending deformation, and to be excellent in terms of strength and deformability.

With respect to such demand, a high-deformability steel pipe in which ferrite is dispersed in bainite is suggested (for example, refer to Patent Citation 1). In addition, coating is carried out on a line pipe from the viewpoint of corrosion prevention. At this time, a cold-formed steel pipe is heated up to about 300° C., which ages the steel pipe. Therefore, the stress-strain curve is significantly altered, for example, yield elongation is observed, in comparison to a moment when the steel pipe is manufactured (before coating).

In order to suppress such strain aging caused by forming and heating, a steel pipe in which Ni, Cu, and Mo are used is suggested (for example, refer to Patent Citations 2 and 3). In the steel pipes as disclosed in Patent Citations 1 to 3, the strength is increased by hard bainite, and the deformability is improved by soft ferrite. Therefore, it was necessary to control the amount of ferrite by the start temperature and the cooling rate of the controlled cooling after hot rolling.

PATENT CITATION

[Patent Citation 1] Japanese Unexamined Patent Application, First Publication No. 2003-293089

[Patent Citation 2] Japanese Unexamined Patent Application, First Publication No. 2006-144037

[Patent Citation 3] Japanese Unexamined Patent Application, First Publication No. 2006-283147

SUMMARY OF THE INVENTION

Problems to be Solved by the Invention

However, when the strength of a steel pipe is improved by bainite, it is necessary to control the composition of the steel so as to increase the hardenability. As a result, it becomes difficult to generate granular ferrite (pro-eutectoid ferrite) during cooling, and, for example, lamellar ferrite is generated so that the toughness is impaired. In the present invention, a high-strength steel pipe having a predetermined single bainite microstructure that is advantageous for productivity and having a sufficient deformability even after the steel pipe is aged due to heating, for example, in coating and the like, and a producing method thereof are provided in consideration of the above circumstances.

Methods for Solving the Problem

The inventors found that it is effective to stop accelerated cooling at a high temperature before bainite transformation is finished in order to improve the deformability of a steel pipe having bainite. Furthermore, the inventors found that the recovery of strain induced by accelerated cooling and bainite transformation, that is, a decrease of the dislocation density in steel improves the deformability of a steel pipe and also allows the excellent deformability even after aging. When accelerated cooling is stopped at a high temperature, bainite transformation is not completed, and therefore austenite remains as a balance of bainite. The remaining austenite transforms into bainite even after the stop of the accelerated cooling (during slow cooling, for example, during air cooling), and the bainite transformation is completed in a range from the stop temperature of the accelerated cooling to a temperature about 50° C. lower than this stop temperature. Since strain in the bainite is recovered by the stop of the accelerated cooling at a high temperature, bainite generated during the accelerated cooling is relatively soft. In addition, bainite generated after the stop of the accelerated cooling is harder than bainite generated during the accelerated cooling since the transformation is completed at a relatively low temperature. As such, when the stop temperature of the accelerated cooling increases, two kinds of bainite are generated, and the heterogeneity of the microstructure increases. Furthermore, maintaining a steel pipe at a high temperature for a relatively long time (that is, slow cooling after accelerated cooling) recovers strain across the entire microstructure. As such, a steel having a high deformability can be manufactured by both of the heterogeneity of the microstructure and the recovery of strain.

The present invention has been made based on such findings, and the summery is as follows:

(1) A high-strength steel pipe according to an aspect of the present invention includes, by mass %, C: 0.02% to 0.09%, Mn: 0.4% to 2.5%, Cr: 0.1% to 1.0%, Ti: 0.005% to 0.03%, Nb: 0.005% to 0.3%, and a balance consisting of Fe and inevitable impurities, in which Si, Al, P, S, and N are limited to 0.6% or less, 0.1% or less, 0.02% or less, 0.005% or less, 0.008% or less, respectively, the bainite transformation index BT obtained by the equation (2) below is 650° C. or lower, and the microstructure thereof is a single bainite microstructure including first bainite and second bainite, the first bainite being a gathered microstructure of bainitic ferrite including no carbide, and the second bainite being a mixed microstructure of bainitic ferrite including no carbide and cementite between the bainitic ferrites.

(2) The high-strength steel pipe according to (1) may further include, by mass %, at least one of Ni: 0.65% or less, Cu: 1.5% or less, Mo: 0.3% or less, and V: 0.2% or less.

(3) In the high-strength steel pipe according to (1), the total amount of the first bainite and the second bainite may be 95% or more of the entire microstructure.

(4) In the high-strength steel pipe according to (1), the product of the tensile strength in the pipe axial direction and an n value in a tensile strain of 1% to 5% may be 60 or higher when an aging treatment is carried out at 200° C.

(5) A producing method of the high-strength steel pipe according to an aspect of the present invention includes: heating a steel satisfying the chemical composition according to (1) or (2); performing a hot rolling of the steel in which a finishing rolling in a range of 750° C. to 870° C. is performed; starting an accelerated cooling of the steel having a cooling rate of 5° C./s to 50° C./s at 750° C. or higher, stopping the accelerated cooling of the steel in a range of 500° C. to 600° C., and performing an air-cooling of the steel so as to make a steel plate; and cold-forming the steel plate into a pipe shape, and welding abutting edges of the steel plate.

Effects of the Invention

According to the present invention, it is possible to provide a high-strength steel pipe having a predetermined single bainite microstructure that is advantageous for productivity and having a sufficient deformability even after the steel pipe is aged due to heating, for example, in coating and the like, and a producing method thereof, and therefore the industrial contribution is extremely significant.

DETAILED DESCRIPTION OF THE INVENTION

The inventors firstly studied the relationship between the stop temperature of the accelerated cooling and the mechanical properties for a steel whose chemical composition was controlled so that the microstructure of the steel becomes bainite. The product [TS×n] of the tensile strength TS and the n value was used as an index representing the balance between the strength and the ductility for the mechanical properties. Here, the n value is an ordinary index that evaluates work-hardening, and is obtained from the relationship between the true stress a and the true strain σ in the equation (1) below (the stress-strain curve).

$$\sigma=K\epsilon^n \quad (1)$$

Since the correlationship between the n value obtained in a range of 1% to 5% of the strain amount by a tensile test and the buckling characteristics of a steel pipe is significant, the n value is obtained in a range of 1% to 5% of the strain amount in the present invention. That is, the relationship between the true stress σ and the true strain ϵ is obtained by a tensile test, and the exponential (the n value) in the equation (1) is obtained from the relationship between the true stress a and the true strain ϵ in a range of 1% to 5% of the strain amount. Meanwhile, the parameter K in the equation (1) is a constant determined by materials.

Figure 1:
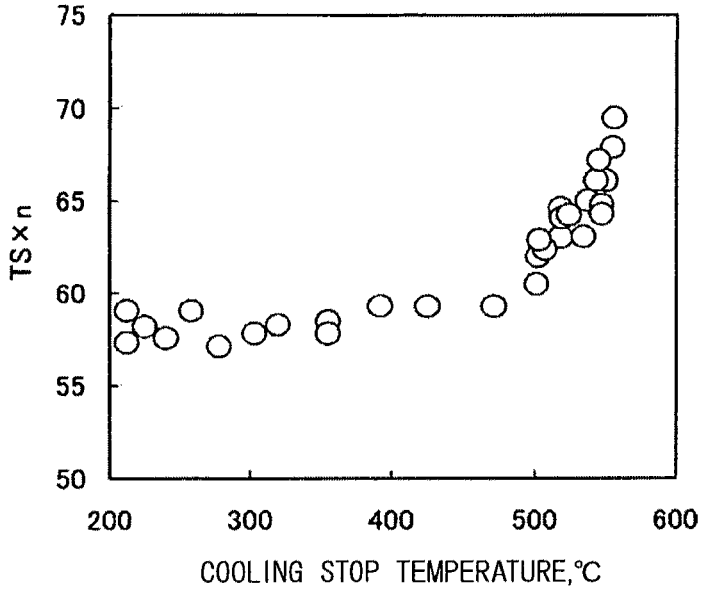
FIG. 1 is a diagram showing the relationship between the stop temperature of the accelerated cooling and the strength-ductility balance.

The relationship between the stop temperature of the accelerated cooling (cooling stop temperature) and the strength-ductility balance [TS×n] is shown in FIG. 1. As shown in FIG. 1, when the cooling stop temperature increases, the strength-ductility balance [TS×n] increases. That is, the balance between the strength and the ductility of a steel having a single bainite microstructure is improved by an increase in the cooling stop temperature. The balance between the strength and the ductility of the steel is considered to be improved due to the following reason. When accelerated cooling is stopped at a relatively high temperature, since the bainite transformation is not completed, austenite remains as a balance of bainite. The remaining austenite transforms into bainite even after the stop of the accelerated cooling (for example, during air cooling), and the bainite transformation is completed in a range from the stop temperature of the accelerated cooling to a temperature about 50° C. lower than this stop temperature. Since strain generated by the accelerated cooling and the bainite transformation is recovered when the accelerated cooling is stopped at a high temperature, bainite generated during the accelerated cooling is relatively soft. In addition, bainite generated after the stop of the accelerated cooling is harder than bainite generated during the accelerated cooling since the transformation is completed at a relatively low temperature. As such, when the stop temperature of the accelerated cooling increases, two kinds of bainite are generated, and the heterogeneity of the microstructure increases. Furthermore, maintaining a steel pipe at a high temperature for a relatively long time (for example, air-cooling after accelerated cooling) recovers strain across the entire microstructure. As such, a steel having a high strength-ductility balance (deformability) can be manufactured by both of the heterogeneity of the microstructure and the recovery of strain.

Figure 2:
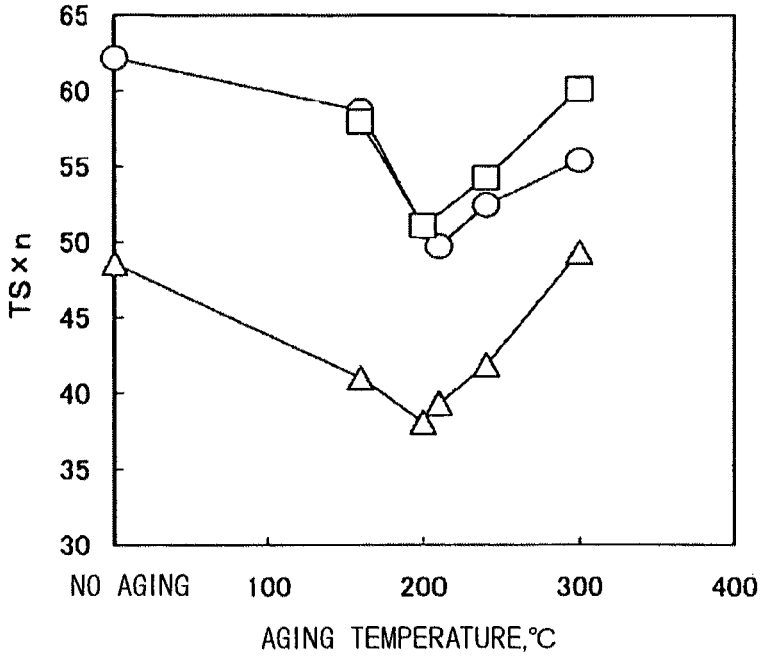
FIG. 2 is a diagram showing the relationship between the aging temperature and the strength-ductility balance after aging.

Next, the inventors carried out studies regarding the influence of aging when corrosion preventive coating is carried out on a steel pipe. The temperature range of coating heating is about 150° C. to 300° C. The inventors carried out studies regarding the variation of the strength-ductility balance [TS×n] with respect to aging temperatures using three kinds of steel pipes having a single bainite microstructure. The results are shown in FIG. 2. As shown in FIG. 2, it was found that the aging temperature at which the strength-ductility balance [TS×n] becomes the smallest is 200° C. for the three kinds of steel pipes represented by the open circle "○," the open triangle "Δ," and the open rectangle "□".

The degradation of the strength-ductility balance by the aging shows the same tendency in a variety of steel pipes. In addition, it was found that a steel pipe having an excellent strength-ductility balance immediately after the production (before aging) has an excellent strength-ductility balance even after aging. It is considered that, since the deformability of a steel pipe immediately after the production (before aging) is improved by the recovery of strain introduced by the accelerated cooling and the bainite transformation, an excellent strength-ductility balance can be obtained even after aging. Therefore, in the present invention, the dislocation density in the microstructure of the steel pipe is reduced, and the deformability of the steel pipe after aging is excellent.

In addition, even when the stop temperature of the accelerated cooling increases to 500° C. or higher, it is necessary to control the chemical composition of the steel in an appropriate range in order to complete the bainite transformation. The inventors carried out studies regarding the influence of the chemical composition on the bainite transformation. As a result, it was found that the bainite transformation was completed even when the accelerated cooling was stopped at 500°

C. or higher as long as the bainite transformation index BT obtained by the equation (2) below was 650° C. or lower.

$$BT=830-270[C]-90[Mn]-37[Mo]-70[Ni]-83[Cr] \quad (2)$$

Here, the [C], [Mn], [Mo], [Ni], and [Cr] are the amounts of C, Mn, Mo, Ni, and Cr, respectively.

Hereinafter, the present invention will be described in detail.

Firstly, the chemical elements in the steel pipe will be described. Meanwhile, the amounts (%) of the chemical elements are all represented by mass %.

C: 0.02% to 0.09%

C is an extremely effective element for improving the strength of steel. 0.02% or more of C is added to steel in order to obtain a sufficient strength. On the other hand, when the amount of C is larger than 0.09%, the low-temperature toughness of the base metal (parent material) and the heat affected zones is degraded, and the on-site weldability is deteriorated. Therefore, the upper limit of the amount of C is 0.09%. As a result, the amount of C is 0.02% to 0.09%.

Mn: 0.4% to 2.5%

Mn is an extremely important element for improving the balance between the strength and the low-temperature toughness. Therefore, 0.4% or more of Mn is added to steel. On the other hand, when the amount of Mn is larger than 2.4%, segregation at the center of the plate thickness (center segregation) which is parallel to the surface of the steel plate becomes significant. The upper limit of the amount of Mn is set to 2.4% in order to suppress degradation of the low-temperature toughness caused by the center segregation. As a result, the amount of Mn is 0.4% to 2.5%.

Cr: 0.1% to 1.0%

Cr increases the strength of the base metal and the weld. Therefore, 0.1% or more of Cr is added to steel. However, when the amount of Cr is larger than 1.0%, the HAZ toughness and the on-site weldability are significantly degraded, and therefore the upper limit of the amount of Cr is set to 1.0% or lower. As a result, the amount of Cr is 0.1% to 1.0%.

Ti: 0.005% to 0.03%

Ti forms fine TiN, and refines the microstructure of the base metal and the heat affected zones, thereby contributing to toughness improvement. These effects are exhibited extremely significantly by the combined addition with Nb. It is necessary to add 0.005% or more of Ti to steel in order to sufficiently develop these effects. On the other hand, when the amount of Ti is larger than 0.03%, coarsening of TiN and precipitation hardening by TiC occur, and therefore the low-temperature toughness is degraded. Therefore, the upper limit of the amount of Ti is limited to 0.03%. As a result, the amount of Ti is 0.005% to 0.03%.

Nb: 0.005% to 0.3%

Nb not only suppresses recrystallization of austenite during controlled rolling so as to refine the microstructure, but also increases hardenability so as to improve the toughness of steel. It is necessary to add 0.005% or more of Nb to steel in order to obtain these effects. On the other hand, when the amount of Nb is larger than 0.3%, the toughness of the heat affected zones is degraded, and therefore the upper limit of the amount of Nb is set to 0.3% or lower. As a result, the amount of Nb is 0.005% to 0.3%.

Si: 0.6% or less (including 0%)

Si is an element that acts as a deoxidizing agent and contributes to strength improvement. When more than 0.6% of Si is added to steel, the on-site weldability is degraded, and therefore the upper limit of the amount of Si is limited to 0.6%. In addition, it is preferable to add 0.001% or more of Si for deoxidizing. Furthermore, it is more preferable to add 0.1% or more of Si in order to increase the strength.

Al: 0.1% or less (not including 0%)

Al is an element that is normally used as a deoxidizing agent and refines the microstructure. However, when the amount of Al exceeds 0.1%, Al-based nonmetallic inclusions increases such that the cleanness of steel is impaired. Therefore, the upper limit of the amount of Al is limited to 0.1%. In addition, it is preferable to add 0.001% or more of Al in order to fix the solute N in steel, which affects aging hardening, by the precipitation of AlN.

P: 0.02% or less (including 0%)

P is an impurity. The upper limit of the amount of P is limited to 0.02% or less in order to improve the low-temperature toughness of the base metal and the heat affected zones. When the amount of P is reduced, grain boundary fracture is prevented, and the low-temperature toughness is improved. Meanwhile, the smaller the amount of P is, the better; however, 0.001% or more of P may generally be included in steel from the standpoint of the balance between the performance and the cost.

S: 0.005% or less (including 0%)

S is an impurity. The upper limit of the amount of S is set to 0.005% or less in order to improve the low-temperature toughness of the base metal and the heat affected zones. When the amount of S is reduced, the amount of MnS, which is elongated by hot rolling, is reduced, and it is possible to improve ductility and toughness. The smaller the amount of S is, the better; however 0.0001% or more of S may generally be included in steel from the standpoint of the balance between the performance and the cost.

N: 0.008% or less (including 0%)

N is an impurity. The upper limit of the amount of N is limited to 0.008% or less since the low-temperature toughness is degraded due to coarsening of TiN. In addition, N forms TiN, and suppresses coarsening of crystal grains in the base metal and the heat affected zones. It is preferable to include 0.001% or more of N in steel in order to improve the low-temperature toughness.

Bainite transformation index BT: 650° C. or lower

In the present invention, it is extremely important to set the bainite transformation index BT, which is obtained by the equation (1) as described above, to 650° C. or lower by controlling the amounts of C, Mn, Mo, Ni, and Cr in steel. As described above, the bainite transformation is completed even when the accelerated cooling is stopped at 500° C. or higher as long as the bainite transformation index BT is set to 650° C. or lower. As a result, dislocation density is lowered by the recovery during air cooling after the stop of the accelerated cooling, and deformability immediately after the production (before aging) and deformability after aging, that is, deformation properties, are increased. Meanwhile, when Mo and Ni are not included, the BT is obtained by considering the amounts of Mo and Ni as '0'. The upper limit of the BT is not limited, but may be 780.3° C. or lower in consideration of the lower limits of the amounts of C, Mn, and Cr.

Furthermore, at least one of Ni, Cu, Mo, and V may be added to steel in order to improve strength.

Ni: 0.65% or less (including 0%)

Ni is an element that improves strength without degrading the low-temperature toughness. When the amount of added Ni exceeds 0.65%, the HAZ toughness is degraded. Therefore, the upper limit of the amount of Ni is preferably 0.65% or less.

Cu: 1.5% or less (including 0%)

Cu is an element that improves the strength of the base metal and the heat affected zone. When the amount of added Cu exceeds 1.5%, the on-site weldability is degraded. Therefore, the upper limit of the amount of Cu is preferably 1.5% or less.

Mo: 0.3% or less (including 0%)

Mo is an element that improves hardenability so as to increase strength. When the amount of added Mo exceeds 0.3%, the HAZ toughness is degraded. Therefore, the upper limit of the amount of Mo is preferably 0.3% or less.

V: 0.2% or less (including 0%)

Similarly to Nb, V contributes to the refining of the microstructure and an increase in hardenability, and increases the toughness of steel. However, the effect of adding V is small in comparison to Nb. In addition, V is effective in suppressing the softening of the weld. The upper limit of the amount of V is preferably 0.2% or less in terms of securing the toughness of the weld.

Figure 3:
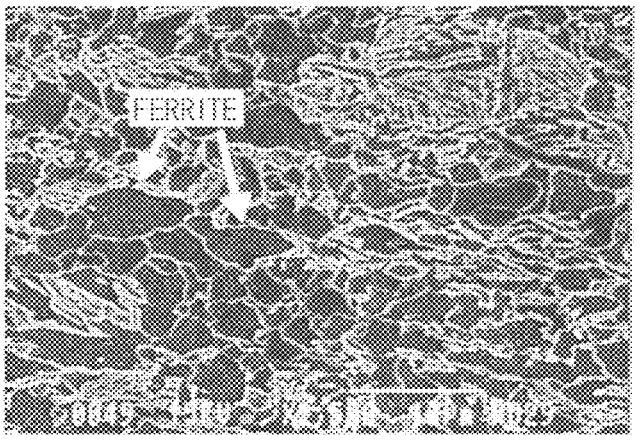
FIG. 3 is an example of a microstructure having ferrite and bainite.
Figure 4:
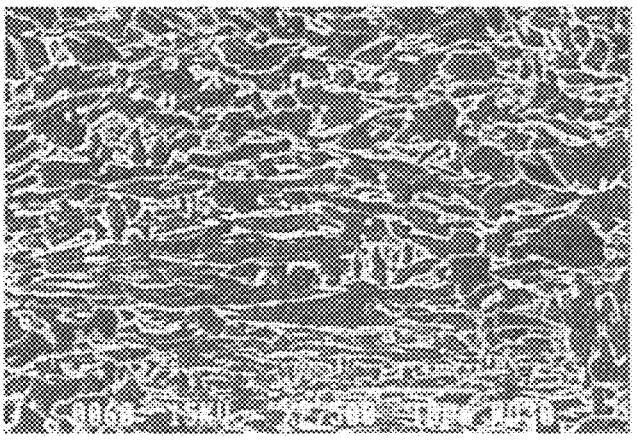
FIG. 4 is an example of a microstructure having a single bainite microstructure.
Figure 5A:
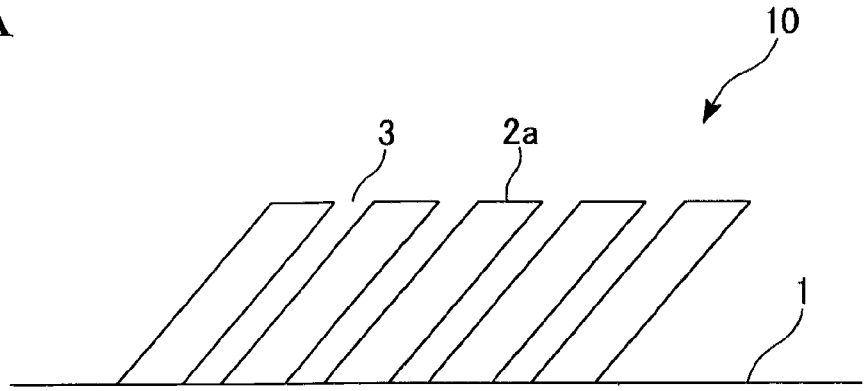
FIG. 5A is a schematic view showing an example of the first bainite.
Figure 5B:
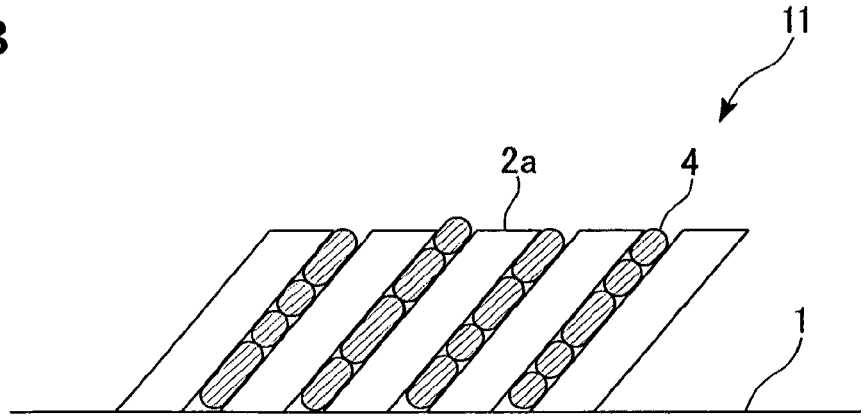
FIG. 5B is a schematic view showing an example of the second bainite.
Figure 5C:
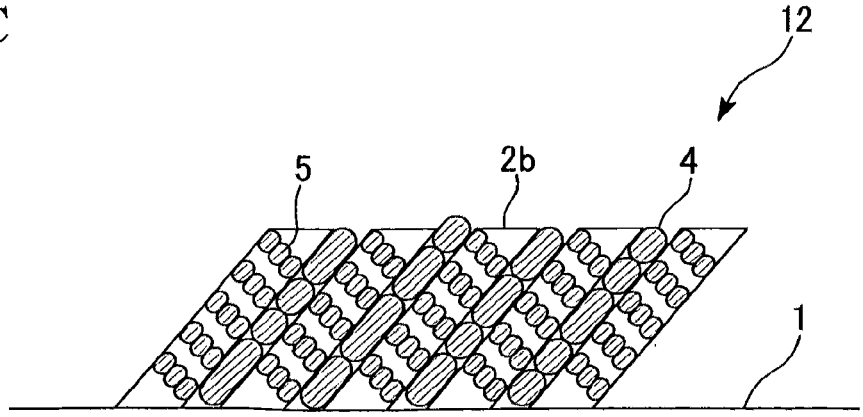
FIG. 5C is a schematic view showing an example of the third bainite.

Next, the morphology of the microstructure of steel will be described. FIG. 3 is an example of a mixed microstructure of ferrite and bainite, and FIG. 4 is an example of a single bainite microstructure. In the present specification, the 'ferrite' is defined as a ferrite crystal grain (ferrite phase) including no lath grain boundary and carbide therein as shown by the arrow in FIG. 3. The ferrite is, for example, pro-eutectoid ferrite. In the present invention, the microstructure of steel is, for example, a single bainite microstructure as shown in FIG. 4. In the present invention, the chemical composition of steel are controlled in order to increase the strength and the toughness of heat affected zones. Therefore, ferrite as shown by the arrow in FIG. 3 is not easily generated in a continuous cooling process with this chemical composition of steel. In addition, variation in the strength properties by aging can be ignored even when ferrite is unexpectedly generated in steel as long as ferrite included in the single bainite microstructure (ferrite fraction) is limited to 5% or less with respect to the entire microstructure. Therefore, 5% or less of ferrite may be included in steel. Meanwhile, these ferrite and bainite can be identified using an optical microscope. Furthermore, there are cases in which 3% or less of a martensite-austenite mixture, that is, martensite-austenite constituent (MA) is included in the single bainite microstructure. However, when the MA is 3% or less, the influence on mechanical properties can be ignored, and therefore 3% or less of the MA may be included in steel. The single bainite microstructure mainly includes the first bainite and the second bainite among the following three kinds of bainite. As shown in FIG. 5A, the first bainite (high-temperature bainite) 10 is a microstructure in which mainly thin bainitic ferrites 2*a* grown from the prior-austenite grain boundaries 1 are gathered. For example, retained austenite 3 may be present between the bainitic ferrites 2*a*. Since the first bainite 10 contains a small amount of C and easily allows strain to be recovered by holding at a high temperature, the first bainite rarely includes carbides and is relatively soft. Therefore, the deformability of a steel pipe can be increased by the first bainite 10. As shown in FIG. 5B, the second bainite (middle-temperature bainite) 11 is a mixed microstructure of the thin bainitic ferrites 2*a* and cementites 4 between the bainitic ferrites 2*a*. The second bainite 11 is hard in comparison to the first bainite 10. Therefore, when the first bainite 10 and the second bainite 11 is included in the microstructure of steel, the heterogeneity of the microstructure increases and the deformability of a steel pipe is further improved. The bainitic ferrite 2*a* included in the first bainite 10 and the second bainite 11 includes no carbide. That is, the single bainite microstructure contains the bainitic ferrite 2*a* having no carbide. Furthermore, as shown in FIG. 5C, the third bainite (low-temperature bainite) 12 is a mixed microstructure of thin bainitic ferrites 2*b* having carbides 5 generated in the grains and cementites 4 between the bainitic ferrites 2*b*. When the third bainite 12 is present, the recovery of strain in the first bainite 10 is not sufficient, and therefore the heterogeneity of the microstructure is not easily generated in strength, and the deformability of a steel pipe is not easily improved. Therefore, the third bainite 12 is preferably as little as possible.

It is necessary to control the third bainite 12 or the bainitic ferrite 2*b* including carbides to be 1% or less in order for strain in the first bainite 10 to be sufficiently recovered. Meanwhile, the cementite 4 may include carbides such as niobium carbide as impurities.

Therefore, in the present invention, the single bainite microstructure mainly includes the first bainite and the second bainite. The total amount of the first bainite and the second bainite is preferably 95% or more of the entire microstructure. Meanwhile, there are cases in which the third bainite is unexpectedly generated in the single bainite microstructure. Therefore, the single bainite microstructure may include 1% or less of the third bainite. A transmission electron microscope (TEM) can be used in order to identify the three kinds of bainites.

A steel pipe having the above chemical composition and microstructure is excellent in terms of deformation properties, particularly the strength-ductility balance after aging. Generally, a steel pipe for line pipes, which is manufactured by controlled rolling and accelerated cooling, is heated to 150° C. to 300° C. when resin coating is carried out. As shown in FIG. 2, the aging temperature at which the strength-ductility balance is most degraded is 200° C. In the present invention, it is possible to provide a steel pipe for which the product of the tensile strength in the pipe axial direction TS and an n value in a tensile strain of 1% to 5% (work-hardening coefficient) is 60 or higher when an aging treatment is carried out at 200° C. This steel pipe is excellent in terms of deformation properties after aging even when a thermal treatment is carried out at the aging temperature at which the strength-ductility balance is most degraded.

Next, a producing method of the steel pipe according to an embodiment of the present invention will be described.

In the producing method of the steel pipe according to the embodiment, a steel is melted and then cast so as to make a slab (steel), the slab is heated, hot-rolled, and cooled so as to make steel plate, the steel plate is cold-formed into a pipe shape, and the edge portions of the formed steel plate are welded with each other, thereby manufacturing a steel pipe. The manufactured steel pipe is heated to a temperature of 150° C. to 350° C. when the surface of the steel pipe is coated with a film, such as a resin, for corrosion prevention.

The heating temperature of the hot-rolled slab (steel) is not limited, but is preferably 1000° C. or higher in order to decrease the deformation resistance. In addition, it is more preferable to heat the slab to 1050° C. or higher in order to dissolve carbides of Nb and Cr in steel as solutes in steel. On the other hand, when the heating temperature exceeds 1300° C., there are cases in which the size of crystal grains increases, and the toughness is degraded. Therefore, the heating temperature is preferably 1300° C. or lower.

When finishing rolling in hot rolling is carried out at lower than 750° C., ferrite is generated before the rolling, and worked ferrite is generated in the middle of rolling. When worked ferrite is generated, the deformability of the steel pipe is impaired, and therefore the finishing rolling in hot rolling is carried out at 750° C. or higher. On the other hand, it is necessary to complete the hot rolling (the finishing rolling in hot rolling) in a non-recrystallization temperature range in order to improve the strength and the toughness. Therefore, the finishing rolling is carried out at 870° C. or lower. Generally, the start temperature of the finishing rolling is 870° C. or lower, and the stop temperature of the finishing rolling is 750° C. or higher in order to carry out the finishing rolling several times.

Accelerated cooling begins immediately after the hot rolling. Particularly, when the start temperature of the accelerated cooling is significantly lowered below 750° C., lamellar ferrite is generated in steel, and the strength and the toughness are degraded. In addition, when the start of the accelerated cooling is delayed, dislocations introduced by rolling in a non-recrystallization temperature range are recovered such that the strength is degraded.

The stop temperature of the accelerated cooling is extremely important in order to obtain a steel pipe that is excellent in terms of deformation properties. As shown in FIG. 1, generally, when the cooling stop temperature increases, the strength-ductility balance [TS×n] increases. FIG. 1 shows that, when the cooling stop temperature is set to 500° C. or higher, the strength-ductility balance [TS×n] abruptly increases. In the embodiment, the lower limit of the stop temperature of the accelerated cooling is set to 500° C. or higher in order to lower the dislocation density in the steel. After the accelerated cooling is stopped, air cooling (for example, lower than 5° C./s) is carried out, thereby manufacturing a steel plate. As a result, the density of dislocations introduced during bainite transformation is lowered, and the dislocations (strain) are recovered during the air cooling so that the deformation properties of a steel pipe that has a single bainite microstructure can be improved. On the other hand, when the upper limit of the stop temperature of the accelerated cooling exceeds 600° C., lamellar ferrite is generated in the steel, and the strength and the toughness are degraded. Therefore, the stop temperature of the accelerated cooling is 500° C. to 600° C. Here, the cooling rate of the accelerated cooling is 5° C./s to 50° C./s. In addition, the cooling rate of the accelerated cooling is preferably 10° C./s to 50° C./s in order to secure a certain degree of hardenability. The first bainite is mainly generated during the accelerated cooling, and the second bainite is mainly generated immediately before the stop of the accelerated cooling and after the stop of the accelerated cooling. Therefore, a mixed microstructure of the first bainite and the second bainite can be obtained as described above by controlling the cooling rate and the cooling stop temperature in this manner. Meanwhile the third bainite is barely generated in this case since the third bainite is generated at, for example, 450° C. or lower.

The manufactured steel plate is cold-formed into a pipe shape, and the abutting edges are welded, thereby manufacturing a steel pipe. The UOE process or the bend process is preferable from the viewpoint of productivity. In addition, use of the submerged arc welding is preferable for the welding of the abutting edges.

Generally, corrosion preventive coating, such as resin coating, is carried out on steel pipes. In this case, the temperature range of the coating heating of the steel pipe is 150° C. to 300° C.

EXAMPLES

Steels including the chemical elements shown in Table 1 were melted and prepared, and slabs obtained by casting the prepared steels were hot-rolled under the conditions shown in Table 2, thereby manufacturing steel plates. Next, the manufactured steel plates were formed into a pipe shape by the UOE process. Furthermore, the inner and outer faces of the steel plate formed into a pipe shape were welded by one layer of submerged arc welding, thereby manufacturing a steel pipe having a plate thickness of 14 mm to 22 mm.

TABLE 1

| Steel | Chemical elements (mass %) | | | | | | | | | | | | | | BT | |
|---|---|---|---|---|---|---|---|---|---|---|---|---|---|---|---|---|
| No. | C | Si | Mn | P | S | Ti | Nb | Al | N | Cr | Ni | Cu | Mo | V | ° C. | Note |
| A | 0.090 | 0.25 | 2.30 | 0.007 | 0.0020 | 0.01 | 0.030 | 0.022 | 0.001 | 0.23 | | | | 0.05 | 580 | Example |
| B | 0.070 | 0.20 | 1.80 | 0.006 | 0.0020 | 0.01 | 0.031 | 0.043 | 0.004 | 0.24 | | | 0.100 | | 625 | |
| C | 0.060 | 0.23 | 1.82 | 0.006 | 0.0016 | 0.01 | 0.028 | 0.032 | 0.002 | 0.52 | | 0.30 | | | 607 | |
| D | 0.070 | 0.22 | 1.99 | 0.007 | 0.0020 | 0.01 | 0.031 | 0.063 | 0.007 | 0.17 | 0.40 | | | 0.03 | 590 | |
| E | 0.060 | 0.23 | 2.12 | 0.006 | 0.0020 | 0.01 | 0.028 | 0.006 | 0.008 | 0.55 | | | | 0.03 | 577 | |
| F | 0.055 | 0.29 | 1.90 | 0.006 | 0.0016 | 0.01 | 0.034 | 0.004 | 0.003 | 0.17 | 0.25 | 0.26 | | | 613 | |
| G | 0.060 | 0.20 | 1.93 | 0.007 | 0.0020 | 0.01 | 0.030 | 0.053 | 0.005 | 0.60 | 0.40 | 0.40 | 0.100 | | 559 | |
| H | 0.060 | 0.23 | 1.89 | 0.007 | 0.0020 | 0.01 | 0.030 | 0.042 | 0.003 | 0.11 | 0.17 | 0.19 | 0.220 | | 615 | |
| I | 0.040 | 0.05 | 2.30 | 0.007 | 0.0016 | 0.01 | 0.150 | 0.026 | 0.005 | 0.11 | 0.35 | 1.20 | 0.015 | | 578 | |
| J | 0.080 | 0.20 | 1.10 | 0.007 | 0.0016 | 0.01 | 0.030 | 0.038 | 0.002 | 0.90 | 0.32 | 0.50 | 0.150 | | 607 | |
| K | 0.010 | 0.20 | 2.40 | 0.007 | 0.0016 | 0.01 | 0.030 | 0.058 | 0.006 | 0.16 | 0.32 | 0.50 | | | 576 | Comparative |
| L | 0.070 | 0.20 | 0.30 | 0.007 | 0.0016 | 0.01 | 0.030 | 0.028 | 0.005 | 0.12 | 0.32 | | 0.150 | | 746 | Example |
| M | 0.060 | 0.20 | 1.30 | 0.006 | 0.0013 | 0.01 | 0.030 | 0.022 | 0.005 | 0.34 | | | | | 669 | |
| N | 0.030 | 0.30 | 1.80 | 0.007 | 0.0016 | 0.01 | 0.030 | 0.028 | 0.004 | 0.10 | | | | | 652 | |
| O | 0.050 | 0.30 | 1.18 | 0.007 | 0.0016 | 0.01 | 0.030 | 0.028 | 0.004 | 0.10 | 0.30 | 0.10 | 0.100 | | 677 | |

Underlined columns do not satisfy the range according to the present invention.

TABLE 2

| | | Finishing rolling | | Accelerated cooling | | | |
|---|---|---|---|---|---|---|---|
| Production No. | Steel No. | Start temperature ° C. | Stop temperature ° C. | Start temperature ° C. | Stop temperature ° C. | Cooling rate ° C./s | Note |
| 1 | A | 845 | 791 | 758 | 512 | 25 | Example |
| 2 | B | 851 | 790 | 789 | 536 | 36 | |
| 3 | C | 863 | 788 | 795 | 514 | 48 | |
| 4 | D | 765 | 795 | 771 | 528 | 15 | |
| 5 | E | 863 | 784 | 781 | 537 | 26 | |

TABLE 2-continued

| Production No. | Steel No. | Finishing rolling Start temperature ° C. | Finishing rolling Stop temperature ° C. | Accelerated cooling Start temperature ° C. | Accelerated cooling Stop temperature ° C. | Cooling rate ° C./s | Note |
|---|---|---|---|---|---|---|---|
| 6 | F | 855 | 792 | 765 | 518 | 16 | |
| 7 | G | 851 | 803 | 771 | 519 | 53 | |
| 8 | H | 856 | 791 | 781 | 565 | 52 | |
| 9 | I | 842 | 812 | 759 | 515 | 26 | |
| 10 | J | 854 | 814 | 761 | 523 | 25 | |
| 11 | K | 856 | 792 | 780 | 519 | 48 | Comparative |
| 12 | L | 842 | 814 | 771 | 536 | 25 | Example |
| 13 | M | 842 | 803 | 771 | 510 | 20 | |
| 14 | N | 842 | 790 | 760 | 530 | 27 | |
| 15 | O | 863 | 788 | 780 | 560 | 16 | |
| 16 | E | 854 | 814 | 761 | 440 | 25 | |
| 17 | A | 765 | 790 | 768 | 400 | 25 | |
| 18 | B | 845 | 797 | 780 | 240 | 35 | |
| 19 | B | 863 | 789 | 752 | 212 | 21 | |

Underlined columns do not satisfy the range according to the present invention.

The presence and absence of the generation of ferrite was confirmed by observing the microstructure of the manufactured steel pipe using an optical microscope. In addition, the kind of the bainite was confirmed using a scanning electron microscope (SEM) or a transmission electron microscope (TEM). Furthermore, after part of the steel pipe was cut out, and an aging treatment was carried out at 200° C. using a salt bath, an arcuate overall thickness tensile test specimen (API standard) was sampled, and a tensile test was carried out in the pipe axial direction. A stress-strain curve was obtained by this tensile test, and the 0.2% proof stress YS, the tensile strength TS, and the work-hardening coefficient (n value) were evaluated. Meanwhile, the work-hardening coefficient (n value) was calculated from the relationship between the true stress $\sigma$ and the true strain $\epsilon$ in a tensile strain of 1% to 5% (the stress-strain curve) using the equation (1) as described above. In addition, the strength-ductility balance [TS×n] was calculated from the product of the tensile strength TS and the work-hardening coefficient (n value).

The results are shown in Table 3. Table 1 shows the chemical elements of the steels, and Table 2 shows the producing methods of the steel pipes. As shown in Table 3, the steel pipes of Examples 1 to 10 were a single bainite microstructure having the first bainite (B1) and the second bainite (B2). In addition, ferrite (F) and the third bainite (B3) were not observed in the single bainite microstructure. Moreover, it was found that the steel pipes (Examples 1 to 10) manufactured under the producing conditions according to the present invention (Production Nos. 1 to 10) shown in Table 2 using steels (A to J) that satisfy the chemical composition according to the present invention shown in Table 1 had an excellent strength (a 0.2% proof stress YS of 550 MPa or higher, and a tensile strength TS of 650 MPa or higher) and a strength-ductility balance [TS×n] of 60 or higher. Therefore, all of the steel pipes of Examples 1 to 10 are excellent in terms of uniform elongation uEl. Furthermore, the steel pipes of Examples 1 to 10 had a strength-ductility balance [TS×n] of 60 or higher even when an aging treatment was carried out at 200° C.

TABLE 3

| | Production No. | Steel No. | Micro-structure | Properties before aging 0.2% proof stress MPa | TS MPa | n value — | TS × n MPa | Properties after aging 0.2% proof stress MPa | TS MPa | n value — | TS × n MPa | Note |
|---|---|---|---|---|---|---|---|---|---|---|---|---|
| Example 1 | 1 | A | B1 + B2 | 582 | 688 | 0.097 | 66.7 | 612 | 719 | 0.092 | 66.1 | Example |
| Example 2 | 2 | B | B1 + B2 | 619 | 719 | 0.086 | 61.8 | 650 | 750 | 0.083 | 62.3 | |
| Example 3 | 3 | C | B1 + B2 | 654 | 723 | 0.093 | 67.2 | 680 | 746 | 0.089 | 66.4 | |
| Example 4 | 4 | D | B1 + B2 | 576 | 692 | 0.089 | 61.6 | 599 | 723 | 0.085 | 61.5 | |
| Example 5 | 5 | E | B1 + B2 | 578 | 731 | 0.092 | 67.3 | 601 | 754 | 0.089 | 67.1 | |
| Example 6 | 6 | F | B1 + B2 | 567 | 662 | 0.096 | 63.6 | 590 | 685 | 0.092 | 63.0 | |
| Example 7 | 7 | G | B1 + B2 | 592 | 747 | 0.085 | 63.5 | 611 | 770 | 0.081 | 62.4 | |
| Example 8 | 8 | H | B1 + B2 | 592 | 696 | 0.092 | 64.0 | 616 | 718 | 0.087 | 62.5 | |
| Example 9 | 9 | I | B1 + B2 | 647 | 717 | 0.090 | 64.5 | 670 | 740 | 0.085 | 62.9 | |
| Example 10 | 10 | J | B1 + B2 | 679 | 758 | 0.089 | 67.5 | 701 | 781 | 0.085 | 66.4 | |
| Comparative Example 1 | 11 | K | B | 455 | 582 | 0.093 | 54.1 | 478 | 605 | 0.089 | 53.8 | Comparative Example |
| Comparative Example 2 | 12 | L | F + B | 462 | 599 | 0.095 | 56.9 | 485 | 622 | 0.092 | 57.2 | |
| Comparative Example 3 | 13 | M | F + B | 540 | 650 | 0.083 | 54.0 | 680 | 680 | 0.080 | 54.4 | |
| Comparative Example 4 | 14 | N | F + B | 560 | 640 | 0.082 | 52.5 | 675 | 675 | 0.079 | 53.3 | |
| Comparative Example 5 | 15 | O | F + B | 555 | 628 | 0.089 | 55.9 | 653 | 650 | 0.083 | 54.0 | |
| Comparative | 16 | E | B | 646 | 700 | 0.065 | 45.5 | 668 | 723 | 0.062 | 44.8 | |

TABLE 3-continued

| | Production No. | Steel No. | Micro-structure | Properties before aging: 0.2% proof stress MPa | TS MPa | n value — | TS × n MPa | Properties after aging: 0.2% proof stress MPa | TS MPa | n value — | TS × n MPa | Note |
|---|---|---|---|---|---|---|---|---|---|---|---|---|
| Example 6 | | | | | | | | | | | | |
| Comparative Example 7 | 17 | A | B | 621 | 696 | 0.074 | 51.5 | 640 | 719 | 0.069 | 49.6 | |
| Comparative Example 8 | 18 | B | B | 581 | 654 | 0.076 | 49.7 | 612 | 685 | 0.072 | 49.3 | |
| Comparative Example 9 | 19 | B | B | 662 | 700 | 0.068 | 47.6 | 692 | 723 | 0.063 | 45.5 | |

Underlined columns do not satisfy the range according to the present invention.
B is a mixed microstructure of B1, B2, and B3.

In contrast to the above, the steel pipes of Comparative Examples 1 to 5, for which the steels (K, L, M, N, and O) were used, showed a strength-ductility balance [TS×n] of lower than 60 since the steel pipes did not satisfy the chemical composition according to the present invention. Therefore, it was found that favorable properties (deformability) cannot be obtained in the steel pipes of Comparative Examples 1 to 5. In Comparative Examples 1 and 2, for which the steels (K and L) were used, the strengths (a 0.2% proof stress YS of lower than 500 MPa or higher, and a tensile strength TS of lower than 600 MPa) were lowered since the amounts of C and Mn were small. Therefore, the strength-ductility balance [TS×n] was lower than 60. In Comparative Example 1, not only the first bainite (B 1) and the second bainite (B2) but also the third bainite (B3) were generated in the microstructure. In addition, in Comparative Example 2, ferrite (F) as well as the three kinds of bainite (B1, B2, and B3) were generated. In Comparative Examples 3 to 5, for which the steels (M, N, and O) were used, the bainite transformation index BT exceeded 650° C. In these Comparative Examples 3 to 5, the strength-ductility balances [TS×n] were lower than 60, and ferrite (F) and the third bainite (B3) were generated in the microstructure. Therefore, it was found that the bainite transformation index BT being 650° C. or lower and limiting the amounts of ferrite (F) and the third bainite (B3) are important for securing the strength-ductility balance [TS×n]. Meanwhile, these steel pipes of Comparative Examples 3 to 5 satisfy the chemical composition according to the present invention with the conditions regarding the chemical composition excluding the bainite transformation index BT. In addition, the steel pipes of Comparative Examples 6 to 9 were steel pipes manufactured using the steels (A, E, and B) that satisfy the chemical composition according to the present invention shown in Table 1 under the producing conditions (Production Nos. 16 to 19) in which the stop temperature of the accelerated cooling is lower than 500° C. as shown in Table 2. In these Comparative Examples 6 to 9, the strength-ductility balances [TS×n] were lower than 60, and the third bainite (B3) was generated in the microstructure. Therefore, it was found that favorable properties (deformability) cannot be obtained in these Comparative Examples 6 to 9. Accordingly, it is found that limiting the amount of the third bainite (B3) is important in order to sufficiently secure the deformability. Furthermore, in the steel pipes of Comparative Examples 1 to 9, the strength-ductility balances [TS×n] were lower than 60 when the aging treatment was carried out at 200° C. Meanwhile, the "B" in Table 3 is a microstructure including the first bainite (B1), the second bainite (B2), and the third bainite (B3).

INDUSTRIAL APPLICABILITY

According to the present invention, it is possible to provide a high-strength steel pipe having a single bainite microstructure that is advantageous for productivity and having a sufficient deformability even after the steel pipe is aged due to heating, for example, in coating and the like, and a producing method thereof, and therefore the industrial contribution is extremely significant.

What is claimed is:

1. A high-strength steel pipe comprising, by mass %:
C: 0.02% to 0.09%,
Mn: 0.4% to 2.5%,
Cr: 0.1% to 1.0%,
Ti: 0.005% to 0.03%,
Nb: 0.005% to 0.3%, and
a balance consisting of Fe and inevitable impurities,
wherein Si is limited to 0.6% or less,
Al is limited to 0.1% or less,
P is limited to 0.02% or less,
S is limited to 0.005% or less,
N is limited to 0.008% or less,
a bainite transformation index BT obtained by the following equation (3) is 650° C. or lower, and
a microstructure thereof is a single bainite microstructure including a first bainite and a second bainite, the first bainite being a gathered microstructure of a bainitic ferrite including no carbide, the second bainite being a mixed microstructure of a bainitic ferrite and cementite, in which the bainitic ferrite of the second bainite includes no carbide and in which the cementite of the second bainite exists between the bainitic ferrites of the second bainite, and a ferrite being limited to 5% or less, wherein $$BT=830-270[C]-90[Mn]-37[Mo]-70[Ni]-83[Cr] \quad (3)$$

where the [C], [Mn], [Mo], [Ni], and [Cr] are the amounts of C, Mn, Mo, Ni, and Cr, respectively.

2. The high-strength steel pipe according to claim 1, further comprising, by mass %, at least one of:
Ni: 0.65% or less,
Cu: 1.5% or less,
Mo: 0.3% or less, and
V: 0.2% or less.

3. The high-strength steel pipe according to claim 1 or 2, wherein the total amount of the first bainite and the second bainite is 95% or more of the entire microstructure.

4. The high-strength steel pipe according to claim 1 or 2, wherein the product of a tensile strength in a pipe axial direction and an n value in a tensile strain of 1% to 5% is 60 or higher when an aging treatment is carried out at 200° C.

5. A producing method of a high-strength steel pipe, the method comprising:

heating a steel satisfying the chemical composition according to claim 1 or 2;

performing a hot rolling of the steel in which a finishing rolling in a range of 750° C. to 870° C. is performed;

starting an accelerated cooling of the steel having a cooling rate of 5° C./s to 50° C./s at 750° C. or higher, stopping the accelerated cooling of the steel in a range of 500° C. to 600° C., and performing an air-cooling of the steel so as to make a steel plate; and cold-forming the steel plate into a pipe shape, and welding abutting edges of the steel plate.

* * * * *

UNITED STATES PATENT AND TRADEMARK OFFICE

CERTIFICATE OF CORRECTION

PATENT NO. : 8,685,182 B2
APPLICATION NO. : 13/261070
DATED : April 1, 2014
INVENTOR(S) : Kensuke Nagai et al.

It is certified that error appears in the above-identified patent and that said Letters Patent is hereby corrected as shown below:

In the Specification

Column 3, line 52, change "between the true stress a and the true strain σ" to -- between the true stress σ and the true strain ε --;

Column 3, line 55, change "$\sigma = K\epsilon^{n}$" to -- $\sigma = K\varepsilon^{n}$ --;

Column 3, line 62, change "the true strain ϵ" to -- the true strain ε --;

Column 3, line 64, change "the true stress a" to -- the true stress σ --;

Column 3, line 65, change "the true strain ϵ" to -- the true strain ε --;

Column 11, line 36, change "the true strain ϵ" to -- the true strain ε --.

Signed and Sealed this
Ninth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,685,182 B2
APPLICATION NO. : 13/261070
DATED : April 1, 2014
INVENTOR(S) : Nagai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 96 days.

Signed and Sealed this
Twenty-ninth Day of September, 2015

Michelle K. Lee

Michelle K. Lee
*Director of the United States Patent and Trademark Office*